United States Patent [19]

Bartoli

[11] 4,331,152

[45] May 25, 1982

[54] ORTHOPEDIC SHOE

[76] Inventor: Bruno Bartoli, Via Risorgimento, Monsummano Terme (Pistoia), Italy

[21] Appl. No.: 183,438

[22] Filed: Sep. 2, 1980

[30] Foreign Application Priority Data

Aug. 31, 1979 [IT] Italy ..... 9524 A/79

[51] Int. Cl.[3] ..... A61F 5/14

[52] U.S. Cl. ..... 128/591; 128/80 R

[58] Field of Search ..... 128/589, 590, 591, 592, 128/80 E, 80 G, 80 R

[56] References Cited

U.S. PATENT DOCUMENTS 3,585,993 6/1971 Heedly ..... 128/80 E

FOREIGN PATENT DOCUMENTS 358247 4/1921 Fed. Rep. of Germany ..... 128/591

397582 6/1924 Fed. Rep. of Germany ..... 128/591

*Primary Examiner*—John D. Yasko

*Attorney, Agent, or Firm*—McAulay, Fields, Fisher, Goldstein & Nissen

[57] ABSTRACT

An orthopedic shoe in which the tip is automatically erected when the wearer's foot is raised to bring it forward to take a step during walking. A flexible metal plate is concealed or sandwiched at one end between two portions of a sole with one portion forming an inner sole and the other portion an outer sole covering the metal plate. The one end of the metal plate is fixed between the soles. The metal plate is connected with a thrust member which includes a thrust bar, and a compression spring which are activated by the position and weight of the foot either to raise the tip of the shoe above the ground or to raise the heel portion above the ground. The thrust action of the spring onto the metal plate causes the toe portion to be elevated, and the force of the thrust bar onto the compression spring causes the heel to be elevated in response to pressure exerted onto the thrust bar by the metal plate. The thrust member is concealed in the heel. The force applied to the free end of the plate has an active component directed towards the soles, which causes the erection of the tip of the shoe with or without rotation.

12 Claims, 5 Drawing Figures

ORTHOPEDIC SHOE

BACKGROUND OF THE INVENTION

This invention relates to an orthopedic shoe. More specifically, the invention is concerned with an orthopedic shoe having a tip which is automatically erected when the wearer's foot is raised from the ground so as to be brought forward and to permit walking.

It is well known that during locomotion, the lower limbs of a human body are both active. During locomotion, one limb is used to support the body on the ground and carries the weight of the body and pushes its center of gravity forward and upward, and the other limb becomes shorter so as to execute a swinging movement and to be brought forward of the one limb; and, during such movement the flexor muscles of the thigh and the muscle groups cooperate with each other and particularly act on the foot for its extension. When such extension is lacking or insufficient, such as for example in hemiplegics, paraplegics, spastics and persons with flaccid paralysis or other infirmities or malformations of the lower limbs, a dragging of the tip of the foot on the ground which causes frequent falls then occurs during forward motion of the limbs.

It is the purpose of the present invention to provide an orthopedic device to assist those who have difficulty in walking.

More specifically, the invention provides for an orthopedic shoe having the orthopedic device which assists in bringing about the automatic erection of the tip of the shoe when the wearer's foot is relieved of the weight of the body and must, during locomotion, be brought forward. This is obtained by means of a strong, flexible and elastic plate underlying the sole. The part of the plate nearest the tip of the shoe is fixed to the sole and the part farthest away is free of the sole and is connected to a member which is concealed in the heel and which pushes the plate toward the tip of the shoe.

One of the advantages of the invention is that the tip of the shoe is automatically raised whenever the shoe is relieved of the weight of the body of the wearer. Further, such raising may involve the entire width of the sole or primarily only one half depending on the infirmity of the wearer's foot; and, such raising also can bring about a torsion of the sole, which raising is of great usefulness in cases of talipes, equinus, varus and supinate.

The orthopedic shoe according to the invention is provided with an automatically erectile tip when the wearer's foot is raised from the ground in order to be brought forward and to permit walking. According to the invention, the erection of the tip is obtained as a result of the effect of a force which turns the tip downward and which force is exerted on the free end of a thin, flexible and elastic metal plate positioned underneath the sole or a conventional inner sole. The part of the plate nearest to the tip of the shoe is fastened to the inner sole and the part farthest away from the tip or front of the inner sole is free, and the end of the plate is turned or directed toward the heel and is connected to a thrust member which is concealed in the heel.

The portion of plate 2 which is fastened to the sole 1 has a width such as to affect either entirely or partly the width of the sole and is applied to the sole in a central or lateral position.

The face of the metal plate is turned downward towards an undersole or outer sole which conventionally is in contact with the ground and is fastened to cover the plate and to provide for an anti-skid surface relative to a walking surface.

The thrust member includes a compression spring which is housed in the heel of the shoe and is connected with a thrust bar or rod which imparts movement to the metal plate and therefore imparts movement to the front or toe portion of the shoe. The rod may be suitably concealed under the arch of the shoe, and the axis of the spring and the rod may be in a plane extending either in the longitudinal axis of the shoe or an axis parallel or oblique thereto.

Other objects, advantages and the nature of the invention will become readily apparent from the detailed description of the invention taken in connection with the accompanying drawings.

DESCRIPTION OF THE PREFERRED EMBODIMENT

Figure 1:
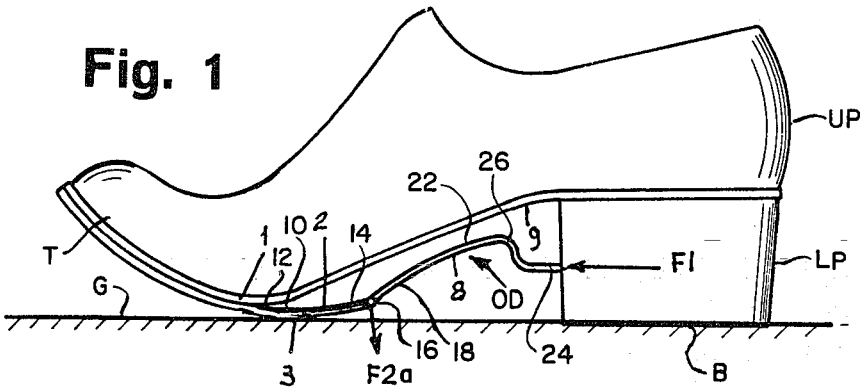
FIG. 1 represents an overall diagrammatic view of a shoe for the right foot according to the invention shown, in the position of non-use.

Referring now more particularly to the drawings in which the same reference characters designate the same parts throughout, the orthopedic shoe according to the invention comprises a conventional upper portion UP of the usual form and structure and a lower portion LP which has been modified to accommodate an orthopedic device OD.

The lower portion LP generally includes a conventional sole 1 and heel 6.

The orthopedic device OD includes a thin, but sturdy flexible and elastic metal plate 2 having a front part 10 fastened by conventional means 12 to the conventional sole 1. Positioned beneath the elastic metal plate 2 is an undersole or outersole 3 which is fixed at the front to sole 1 and performs the function of a normal conventional outer sole to contact the ground G or walking surface on which the shoe wearer walks, and additionally to provide an anti-skid walking surface for the shoe and to cover the elastic metal plate 2 and prevent it from contacting the ground walking surface G. The front of sole 3 is fixed for movement with plate 2.

The other end 14 of metal plate 2 is tapered and is free of connection from the sole 1 and moves with undersole 3. The other end 14 is able to move away from and out of contact with sole 1 under the action of a lateral thrust force. As seen in FIGS. 1 and 3, the other end 14 of plate 2 is out of contact with sole 1, and in FIG. 2, the other end 14 of plate 2 is in contact with sole 1. Sole 1 completely covers the under portion of the shoe from the tip T to the heel.

Heel 6 is generally conventional in all respects except that it is provided with a longitudinal bore 5.

A lateral thrust device is provided which generally includes a compression-type spring 4 housed within longitudinal bore 5 and includes a piston 7 connected with spring 4 and a rod 8 which is connected at one end thereof with piston 7 and at the other end 16 thereof with the free or other end 14 of metal plate 2. Rod 8 suitably fits underneath the arch portion 9 of the shoe upper UP.

Rod 8 is hinged by means of a hinge pin 16 which passes through an opening at end 18 of rod 8 and engages a pair of ears 20 which extend from the other end 18.

Spring 4 can be constructed and arranged or suitably adjusted and dimensioned as is well known to provide for desired amount of thrust to be applied to piston 7 and therefore metal plate 2 through rod 8 so that the thrust can be varied in accordance with the degree of infirmity of the shoe wearer as well as with the weight of the wearer.

The thrust device or member which comprises at least one compression spring 4 is lodged in the bore and secured in the heel. The piston 7 is slidable in the bore 5 in contact with and under control of the spring 4. Rod 8 may also be suitably curved for further concealment under the arch of the shoe while being connected by one part of the piston 7 and by the other part 18 to the free end 14 of the plate 2 by means of hinge pin 16.

In the normal, non-use position of the shoe, thrust bar 8 which includes a first portion 22 which is pivoted at hinge pin 18 to outer sole 3 and a second portion 24 which cooperates with spring 4 and is connected with piston 7. In order to assure appropriate fit under the arch of the shoe, first portion 22 and second portion 24 are interconnected by means of a generally S-shaped or Z-shaped portion 26. As best seen in FIG. 1, in the position of non-use of the shoe, the thrust member in the form of rod 8 under the action of thrust spring 4 is moved towards the left to raise or elevate the toe portion because there is no pressure on spring 4 imparted by metal plate 2. In the FIG. 2 position, when the full weight of the body is on the right foot, rod 8 is moved towards the right to compress spring 4 by causing piston 7 to compress the spring 4. In FIG. 3, when the walking step is partially completed, and the full weight is on the toe portion, the thrust spring then causes the heel to be raised by moving it away from the toe portion.

Figure 4:
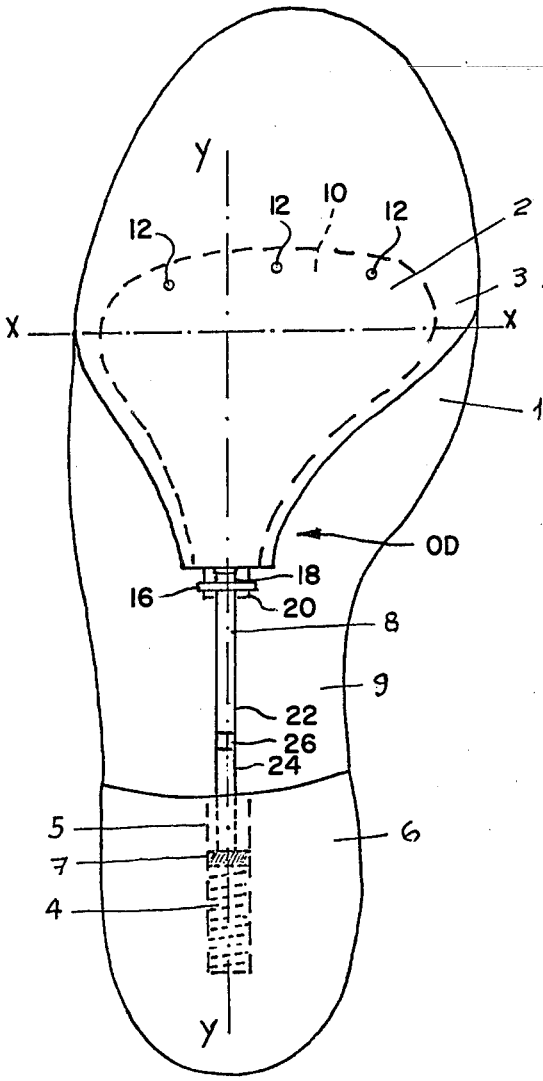
FIG. 4 represents the same shoe as seen from below looking upward towards the bottom of the sole and in which the thrust member is in the FIG. 3 position and acts in the direction of the longitudinal axis of the shoe; and, FIG. 5 represents the same shoe seen from below but modified to have the thrust member offset from the center and in which the thrust member is in the FIG. 2 position and acts in a direction oblique to the longitudinal axis of the shoe.
Figure 5:
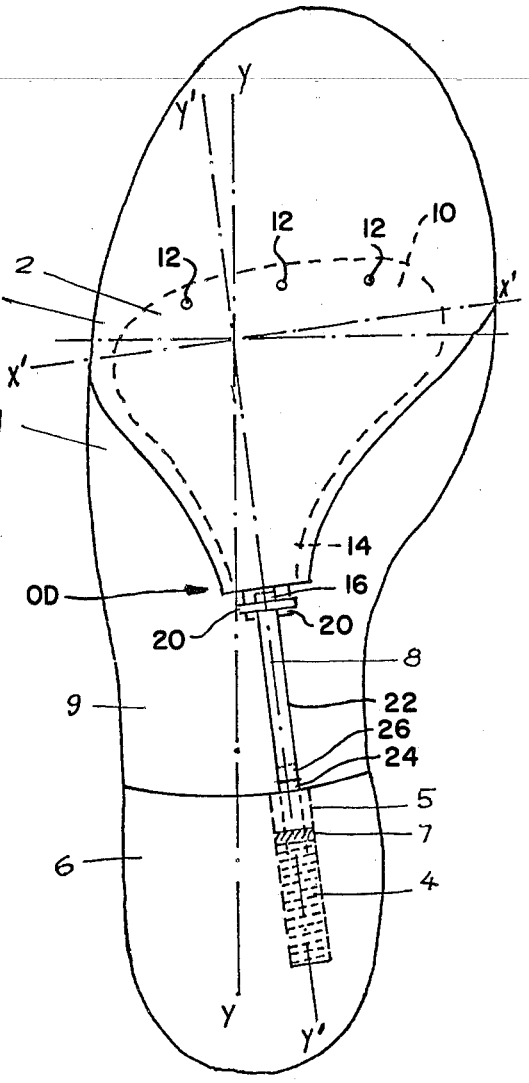

Referring now more particularly to FIGS. 4 and 5, the longitudinal axis of spring 4 and the longitudinal axis of rod 8 lie in a plane which is perpendicular to the plane of undersole or outersole 3 and intersects the plane of the sole in a line of intersection which for sake of simplicity will be referred to as longitudinal axis Y—Y lying in the plane of FIGS. 4 and 5 and extending through spring 4 and rod 8 as shown in FIG. 4. As will be explained further hereinafter, the longitudinal axis Y—Y is moved to its position Y'—Y' in FIG. 5 and is offset at an oblique angle to the longitudinal axis Y—Y of the shoe.

In FIG. 4, the longitudinal axis of the shoe coincides with the line Y—Y which is in the intersection of the plane of the outer sole and heel base with the plane containing rod 8 and spring 4 or at least the central axis thereof. As noted heretofore, metal plate 2 is fixed to sole 1 at front part 10 and flexes outer sole 3 under the action of the spring 4 and rod 8. Axis X—X in FIG. 4 is transverse to or perpendicular to axis Y—Y and the tip T of the shoe undergoes a rotation about the aforesaid axis X—X which is imparted by torsion on the metal plate 2 such that the tip of the shoe is erected.

The spring 4 and rod 8 provide for a thrust force F, in a direction parallel to the plane of the bottom B of the heel and the bottom-most portion of the outer sole 3 as viewed in FIG. 1. Force F1 results in a force F2 which passes through hinge pin 16 and the connection of rod 8 with metal plate 2 and when in FIG. 1 position to exert a force F2*a* in a downward direction towards the walking surface and transverse to force F1. When the shoe is in the FIG. 1 position on the wearer, the thrust force F1 is fully extended towards the left to fully extend rod 8, and thereby move the force F2 to a direction F2*a* to move the metal plate or deflect the metal plate 2 towards the outer sole 3 and thereby raise the tip 1, as shown in FIG. 1. This is the condition with the foot of the wearer raised from the ground and therefore relieved.

Figure 2:
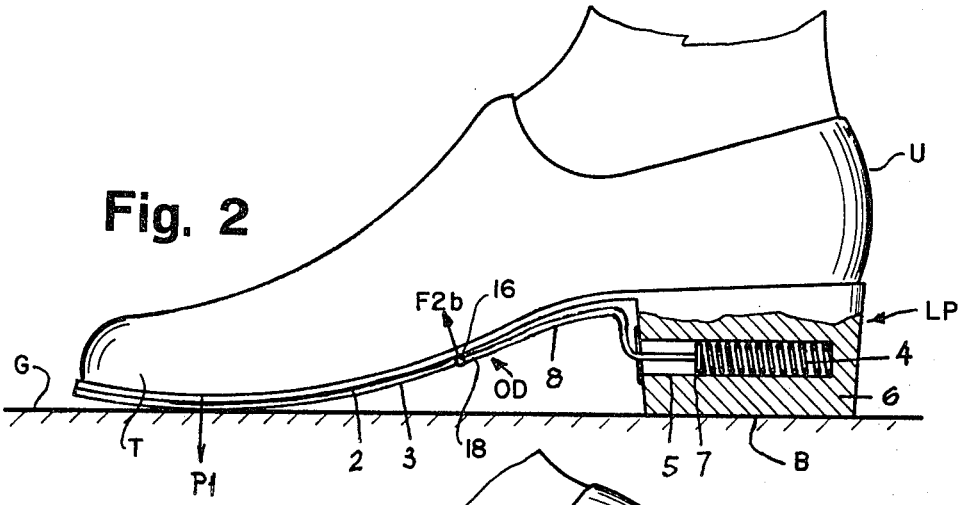
FIG. 2 represents the same shoe in one position of use and with the right foot carrying the weight of the body.
Figure 3:
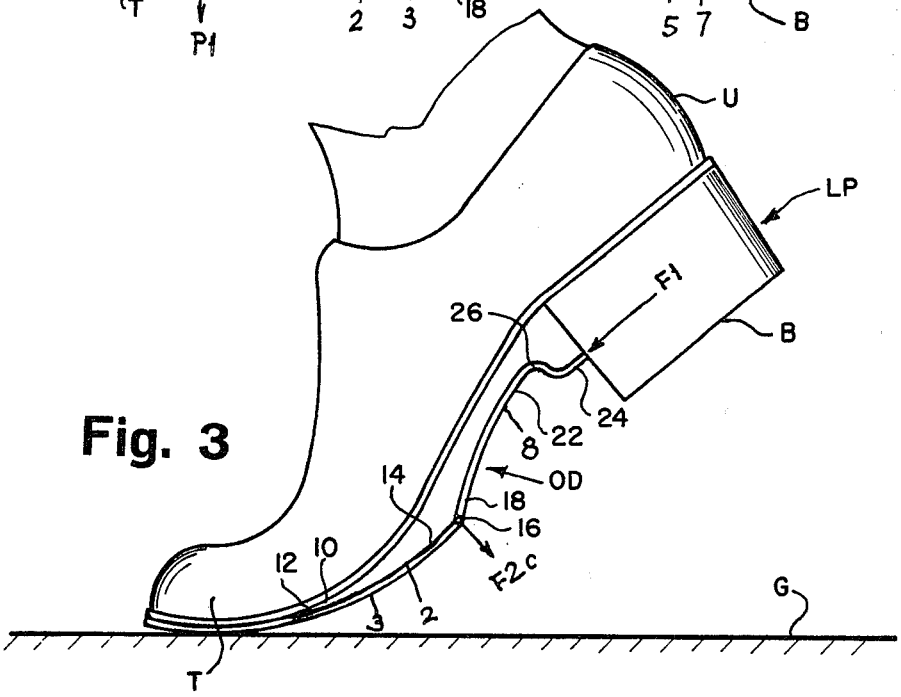
FIG. 3 represents the same shoe in another position of use and with the foot relieved of the weight of the body as in the forward moving stage in walking.

Now, turning to FIG. 2, with the foot of the wearer taking support on the ground and carrying the weight of the body as exemplified by force vector P1. With the weight of the wearer forcing the tip T onto the ground G, plate 2 now causes a reaction so as to reverse the direction of force F2 and cause it to assume the vector position F2*b* which is in a direction opposite to F2*a* and move metal plate 2 into close proximity to and adjacent to under sole 1 and thereby flex outer sole 2 about axis X—X, as best seen in FIG. 4 and at the same time causes thrust bar to move towards the right and compress thrust spring 4 so as to move the second portion 24 of bar 8 into the heel bore 5 and move S-shaped portion 26 adjacent to the heel, as seen in FIG. 2, and as noted in FIG. 5 (assuming for the present that spring 4 and rod 8 were aligned with axis Y—Y).

As soon as the wearer walks slightly forward from the FIG. 2 position, and the weight of the wearer is shifted towards the tip T, then the force of the spring 4 together with piston 7 and rod 8 effectively acts both on the heel and the hinge connection 16 to force the heel to be raised to its FIG. 3 position and at the same time the force F2 reverses and now is directed in the direction F2*a* to force and move the metal plate 2 away from the inner sole 1 and move outer sole 3 away from the inner sole 1 and cause the heel of the shoe to be moved into its raised position.

Referring now more particularly to FIG. 5, which shows bore 5 and the spring 4 off-set from the longitudinal axis Y—Y of the shoe and is moved towards axis Y'—Y'. Rod 8 lies in a plane which is perpendicular to the plane of the bottom B of the heel, but off-set from axis Y—Y to axis Y'—Y'. In this position, it should be noted that the axis of the spring 4 and of the rod 8 are in a plane extending in the longitudinal axis Y'—Y' of the shoe (as illustrated e.g. in FIG. 5) whereby the tip of the shoe undergoes a simple erection by rotation about the transverse axis X'—X'; otherwise in a plane Y'—Y-oblique to plane Y—Y, as viewed in FIG. 5, whereby the tip of the shoe undergoes an erection with torsion by effect of the rotation about the axis X'—X'.

Besides, the part of plate 2 intended to be fixed to the sole 1 has a variable extension in width so as to extend over the entire width of the sole or otherwise over a portion thereof which may be central or lateral relative to the sole.

As will be evident, the embodiment shown in FIG. 5 is a modification of the embodiment shown in FIG. 4. Further, line Y'—Y' is the intersection with the plane of the drawing sheet of a plane which is oblique to the axis Y—Y. In FIG. 4, the axis of spring 4 and the axis of rod 8 are in a plane which extends in the longitudinal axis of the shoe; on the other hand, in FIG. 5, the axis of spring 4 and the axis of rod 8 are in a plane which is oblique to the longitudinal axis of the shoe. And, FIG. 4 can also be considered to be support for the axis of the spring 4 and the axis of rod 8 extending in a plane parallel to the longitudinal axis of the shoe.

It should also be noted that the spring 4 is shown in its extended condition in FIGS. 1 and 3, that is, the extension or second portion 24 of rod 8 is moved to its position outside of bore 5 in heel 6, whereas, the second portion 24 is in the condition compressing spring 4 and moved into bore 5 housed within heel 6. In a similar manner, metal plate 2 which is shown in dashed outline in FIGS. 4 and 5 is shown as holding spring 4 in its compressed condition as shown in FIG. 2.

While there has been shown and described what is considered to be the preferred embodiments of the invention, it will be obvious to those skilled in the art that various changes and modification may be made therein without departing from the scope of the invention.

I claim:

1. An orthopedic shoe with an automatically erectile tip and having a heel, comprising:

a flexible and elastic metal plate having one end fixed to a front part of the sole means of the shoe, and thrust means having one end operatively connected with the other end of said metal plate and another end operatively associated with said heel for movement therein responsive to the portion of said metal plate on which the wearer exerts body weight and for movement of said metal plate to move the sole means to move the tip of the shoe from a position in contact with a walking surface to a raised position away from the walking surface.

2. The orthopedic shoe as claimed in claim 1, wherein said sole means includes an inner sole, and an under sole fixed at one end to said inner sole and having its other end connected with said metal plate for covering said metal plate, and said thrust device includes a thrust spring received in said heel and a thrust bar having one end connected with said thrust spring, and a hinge connection for connecting the other end of said thrust bar with the other end of said metal plate.

3. The orthopedic shoe as claimed in claim 2, wherein said thrust bar and said thrust spring are axially aligned with the longitudinal axis of the shoe.

4. The orthopedic shoe as claimed in claim 2, wherein said thrust bar and said thrust spring are axially aligned along a common axis which is offset from the longitudinal axis of said shoe.

5. The orthopedic shoe as claimed in claim 1, wherein said sole means includes a first sole covering the under portion of the shoe, and a second sole having a front end fixed at the front of the shoe with said first sole and a rear end free of connection with said first sole;

means fixing said one end of said metal plate between said first sole and said second sole at the front end thereof, the other end of said metal plate being free of connection with said first sole; and, said second sole covering said metal plate for concealment thereof and to provide a walking surface for the shoe.

6. The orthopedic shoe as claimed in claim 1, wherein said thrust means includes:

bore means in the heel of the shoe, compression thrust spring means received within said bore means, a thrust bar including a first portion having one end connected with said thrust spring means and a second portion having one end connected with said metal plate, said thrust bar including an S-shaped portion connecting the other ends of said first portion and said second portion to provide for the thrust bar conforming to the under portion of the shoe, and said thrust bar being responsive to pressure being exerted onto said metal plate for moving the tip of the shoe away from the ground and for raising the heel of the shoe above the ground depending upon which portion of said metal plate, pressure is exerted.

7. The orthopedic shoe as claimed in claim 6, wherein said sole means includes an inner sole and an outer sole each having a first portion connected together and each having a second portion freely movable relative to each other, said metal plate having one portion fixed with and connected with the first portion of said inner sole and the first portion of said outer sole, the other end of said plate being free of connection with said inner sole, and said outer sole overlying said metal plate to prevent view thereof.

8. The orthopedic shoe as claimed in claim 7, including a hinge connection connecting the other end of said metal plate with the one end of said second portion of said thrust bar, said thrust bar being movable in a first direction under action of said compression thrust spring means to move said metal plate in a direction towards said inner sole to move the tip of the shoe into an erectile position away from the ground, and said thrust bar being movable in response to pressure on said metal plate for movement of said thrust bar in a second direction opposite to said first direction into said bore means for compression of said compression thrust spring means and for subsequent movement of the heel of the shoe to an elevated position above the ground in response to pressure imparted onto the heel by said thrust bar, said metal plate moving away from said inner sole and moving said outer sole away from said inner sole.

9. The orthopedic shoe as claimed in claim 8, wherein said thrust bar and said spring means lie in a plane along the longitudinal axis of the shoe, and said metal plate moves about an axis perpendicular to said longitudinal axis.

10. The orthopedic shoe as claimed in claim 8, wherein said thrust bar, said bore means and said spring means are axially aligned along an axis oblique to the longitudinal axis of said shoe and said plate rotates about an axis perpendicular to said oblique axis.

11. An orthopedic shoe having a tip, a flexible sole, a heel, an arch and means for automatically erecting said tip and said heel;

said means including:

a plate having a front end and a back end;

said front end being fixed to a front part of said sole;

said back end extending under said arch; and thrust means having one end operatively connected to said back end of said plate and another end operatively connected with said heel for movement relative thereto responsive to the portion of said plate on which the wearer exerts body weight for moving said tip away from the ground and for raising said heel above the ground depending upon which portion of said plate, pressure is exerted.

12. The shoe of claim 11, wherein said plate has a flared front end and a tapered back end.

* * * * *